US006974208B2

(12) United States Patent
Park et al.

(10) Patent No.: US 6,974,208 B2
(45) Date of Patent: Dec. 13, 2005

(54) HEAD OF INKJET PRINTER AND METHOD OF MANUFACTURING THE SAME

(75) Inventors: Sung-joon Park, Suwon (KR); Seo-hyun Cho, Sungnam (KR); Sang-chul Koh, Suwon (KR); Jae-sik Min, Suwon (KR); Tae-kyun Kim, Suwon (KR); Myung-song Jung, Gunpo (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 84 days.

(21) Appl. No.: 10/321,574

(22) Filed: Dec. 18, 2002

(65) Prior Publication Data

US 2003/0117461 A1 Jun. 26, 2003

(30) Foreign Application Priority Data

Dec. 20, 2001 (KR) ..... 2001-81530

(51) Int. Cl.[7] ..... B41J 2/05
(52) U.S. Cl. ..... 347/56; 347/61; 347/64
(58) Field of Search ..... 347/56, 61, 58, 347/64; 216/27, 33; 438/57; 29/890.1

(56) References Cited

U.S. PATENT DOCUMENTS

| | | | | |
|---|---|---|---|---|
| 5,157,418 | A * | 10/1992 | Tamura | 347/58 |
| 5,736,061 | A * | 4/1998 | Fukada et al. | 216/33 |
| 5,801,068 | A * | 9/1998 | Sooriakumar et al. | 438/51 |
| 2003/0131475 | A1 * | 7/2003 | Conta | 29/890.1 |

* cited by examiner

*Primary Examiner*—Hai Pham
*Assistant Examiner*—Lam S. Nguyen
(74) *Attorney, Agent, or Firm*—Staas & Halsey LLP

(57) ABSTRACT

A head of an inkjet printer is formed by bonding of a heater substrate and a nozzle plate. In order to bond the heater substrate where a heater thin film and a protecting film are vapor-deposited, and the nozzle plate where a nozzle is formed, an intermediate layer is formed by forming a thin film of glass on the heater substrate by vapor-depositing, and the nozzle plate is installed on the heater substrate. $SiO_2$ is formed at an interface between the nozzle plate and the heater thin film due to heating and application of an electric field, and thus the nozzle plate and the heater substrate are bonded with an electrostatic force of $SiO_2$. The nozzle plate and the heater substrate are bonded by using the intermediate layer made of the thin film of glass instead of a general polymer as the bonding layer, thereby preventing swelling of the polymer and isolation of layers of the head occurring due to ink penetration into interfaces of the layers. Moreover, a bonding process is performed in wafer units to improve mass productivity.

20 Claims, 8 Drawing Sheets

HEAD OF INKJET PRINTER AND METHOD OF MANUFACTURING THE SAME

CROSS-REFERENCE TO RELATED APPLICATIONS

This application claims the benefit of Korean Patent Application No. 2001-81530, filed Dec. 20, 2001, in the Korean Intellectual Property Office, the disclosure of which is incorporated herein by reference.

BACKGROUND OF THE INVENTION

1. Field of the Invention

The present invention relates to a head of a bubble type inkjet printer and a method of manufacturing the same, and more particularly, to a head of an inkjet printer and a method of manufacturing the same which is characterized by a method of bonding a heater substrate and a nozzle substrate to form the head.

2. Description of the Related Art

In general, an ink discharge method in an inkjet printer is roughly divided into a bubble-jet type, a Mach-jet type, a thermal printing type and a thermal compression type. Here, the bubble-jet type inkjet printer heats liquid ink by a heat generating device to generate a bubble, and discharges ink using the bubble. In a head of the bubble-jet type inkjet printer, a nozzle plate having a nozzle is disposed on one side of a chamber barrier layer providing an ink chamber, and a heater substrate where a heater is installed is arranged to correspond to the ink chamber and disposed on the other side of the chamber barrier layer.

One example of the bubble-jet type inkjet printer will now be explained with reference to FIG. 1. The conventional head of the inkjet printer includes an ink barrier 40 providing an ink chamber 30, a nozzle plate 20 having a nozzle 21 through which ink is charged, and a heater substrate 10 on which a heater thin film 11 is installed, which is bonded to the nozzle plate 20 by using the ink barrier 40 made of a polymer as a bonding layer, and which is made of silicon material.

Ink of the ink chamber 30 is heated by the heater thin film 11 and is ejected through the nozzle 21 by a bubble generated by heating the ink. The ink chamber 30 is formed by stacking a photoresist polymer on the heater substrate 10 and by patterning a resulting structure to position the ink barrier 40 in a heater region of the heater thin film 11. The heater substrate 10 and the nozzle plate 20 are bonded due to heat and pressure by using an adhesive property of the photoresist polymer serving as the ink barrier 40.

When energy is applied to the heater thin film 11 vapor-deposited on the heater substrate 10 to heat ink for 2 to 3 $\mu$s, the bubble is formed on the heater thin film 11, and ink of the ink chamber 30 is externally ejected through the nozzle 21 due to a volume and a pressure of the bubble. The ink barrier 40 serves as the bonding layer so that the heater substrate 10 and the nozzle plate 20 on which a variety of thin films are vapor-deposited can be incorporated. In addition, the ink barrier 40 forms the ink chamber 30 in the heater region. The nozzle plate 20 includes the nozzle 21 for discharging ink corresponding to the heater thin film 11. The nozzle plate 20 is generally made of polyimide or plated nickel. A heatproof layer 12 made of $SiO_2$ is vapor-deposited on the heater substrate 11 to prevent heat of the heater thin film 11 from being discharged. An electrode 13 transmits power to the heater thin film 11. A passivation layer 14 includes an insulating film 14*a* made of SiN:H and vapor-deposited on the heater thin film, a heater protecting film 14*b*, and an insulating film 14*c* made of SiC:H and additionally vapor-deposited to increase durability and chemical resistance of the passivation layer 14.

In a head structure of the inkjet printer, the ink barrier 40 made of the polymer operates as the bonding layer between the heater substrate 10 and the nozzle plate 20 and contacts ink contained in the ink chamber 30. The ink contains at least 60 to 70% of water and soaks into a bulk of the polymer surrounding the ink chamber 30 and a bonding interface of the heater substrate 10, the ink barrier 40 and the nozzle plate 20. This phenomenon expands throughout the polymer and isolates components to cause head defects of the head structure.

In addition, since each ink passage and the ink chamber 30 are filled with a fluid, namely ink, the pressure is transmitted to an adjacent heater chip and other ink passage in an ink discharge, and thus crosstalk is generated to influence bubble formation and ink discharge properties.

In an assembly of the head, the polymer is stacked on the heater substrate 10, then exposed to light and developed, and bonded with the nozzle plate 20. In a case that arrangement is not completely executed in each process, the heater thin film 11, the ink chamber 30 and the nozzle 21 are not precisely aligned to influence directional stability of the ink discharged. As a result, the quality of printing is reduced.

SUMMARY OF THE INVENTION

Accordingly, it is an aspect of the present invention to provide a head of an inkjet printer and a method of manufacturing the same which can prevent reduction of printing quality due to isolation of layers of the head by bonding a heater substrate and a nozzle plate with an electrostatic force instead of bonding the heater substrate and the nozzle plate with a general polymer.

Additional aspects and advantages of the invention will be set forth in part in the description which follows and, in part, will be obvious from the description, or may be learned by practice of the invention.

In order to achieve the above and/or other aspects of the present invention, there is provided a head of a bubble-jet type inkjet printer including a heater substrate having a heater heating ink, a nozzle plate having a nozzle for discharging ink heated by the heater, and an intermediate layer bonding the heater substrate and the nozzle plate with an electrostatic force. Here, a passivation layer can be formed on the heater substrate to protect the heater. The intermediate layer is made of a glass thin film formed on the heater by vapor-depositing on the heater substrate where the passivation layer is vapor-deposited.

In addition, there is provided a method of manufacturing the head of the inkjet printer. The method includes forming the heater substrate where the heater is installed, forming the nozzle plate having the nozzle, and forming the intermediate layer between the heater substrate and the nozzle plate and bonding the heater substrate and the nozzle plate with the electrostatic force.

The bonding of the heater substrate and the nozzle plate includes forming the intermediate layer by forming a thin film of glass on the heater substrate by vapor-depositing, installing the nozzle plate on the intermediate layer, and heating the heater substrate where the nozzle plate is installed to supply an electric field to electrically connect the nozzle plate and the heater substrate when the heater substrate is heated over a predetermined temperature.

In accordance with the present invention, the heater substrate and the nozzle plate are bonded with the electrostatic force by using the glass thin film in manufacturing the head of the inkjet printer instead of using a polymer bonding layer, thereby preventing a defect due to ink penetration into layers by the polymer bonding layer.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
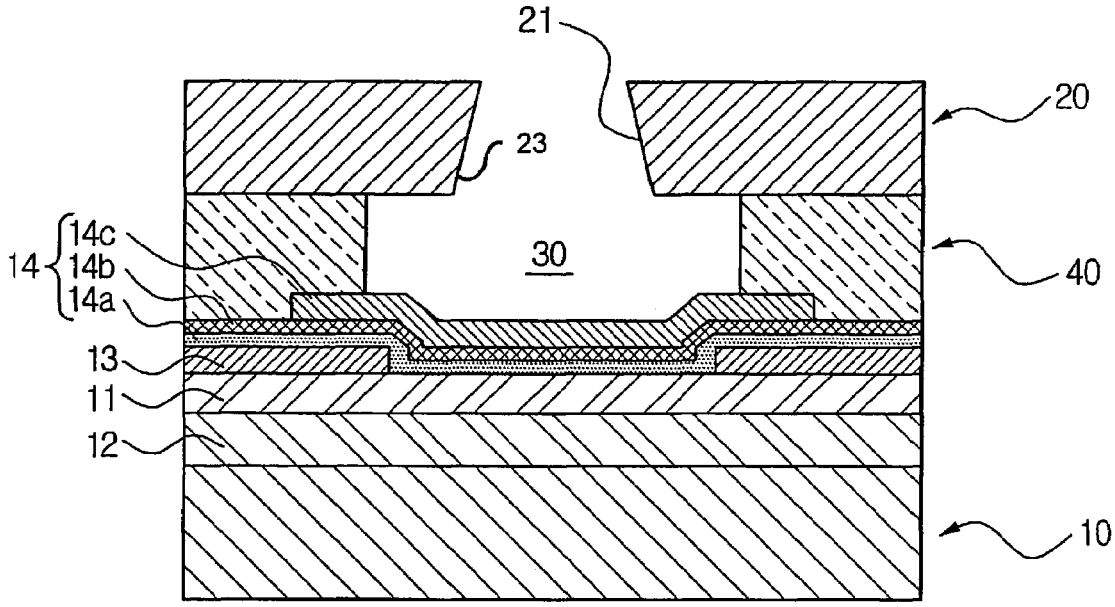
FIG. 1 (PRIOR ART)
FIG. 1 is a cross-sectional diagram illustrating one example of a conventional head of an inkjet printer.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

A head of an inkjet printer and a method of manufacturing the same in accordance with embodiments of the present invention will now be described in detail with reference to the accompanying drawings.

Figure 2:
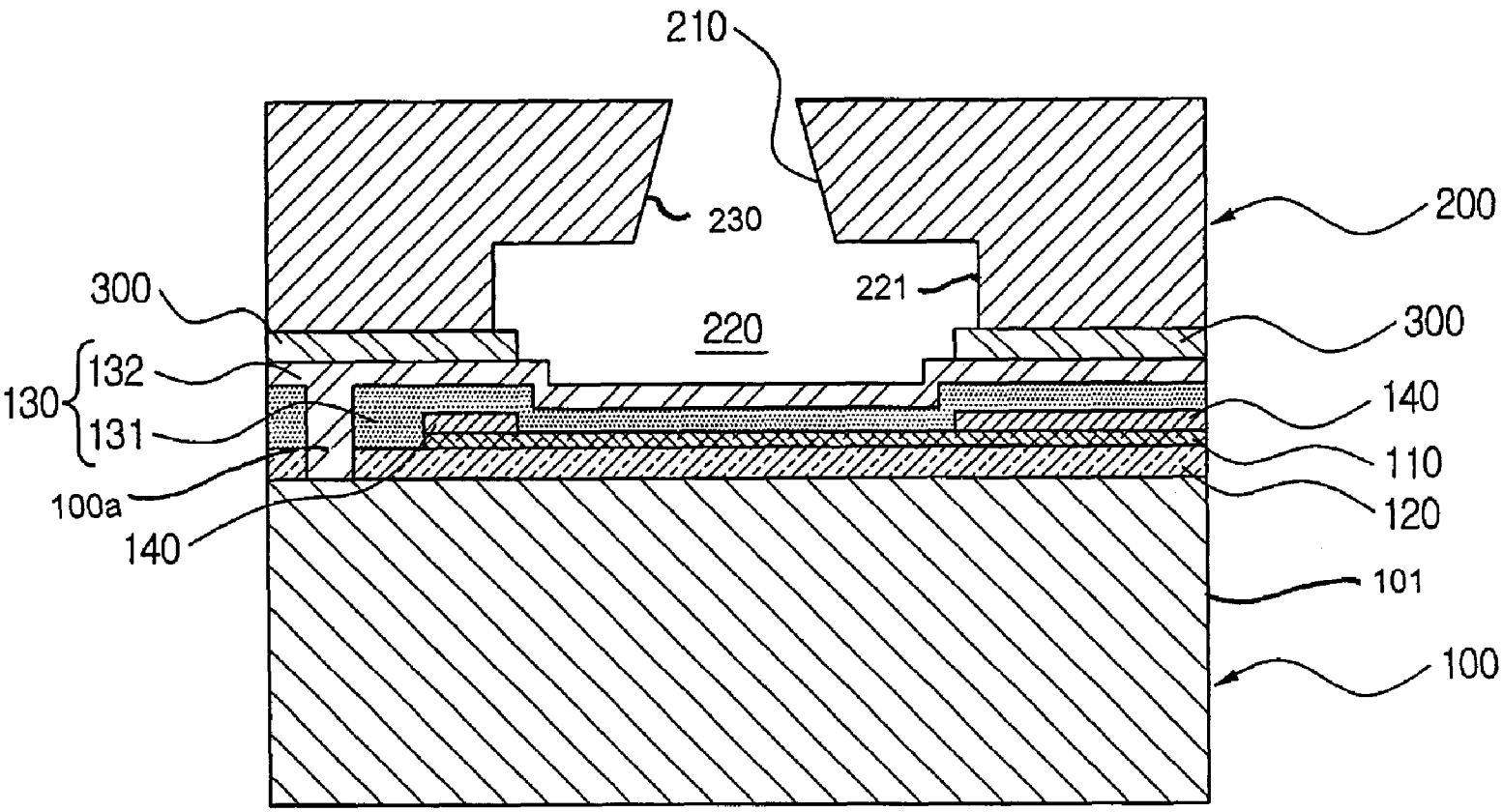
FIG. 2 is a cross-sectional diagram illustrating a head of an inkjet printer in accordance with an embodiment of the present invention.
Figure 3A:
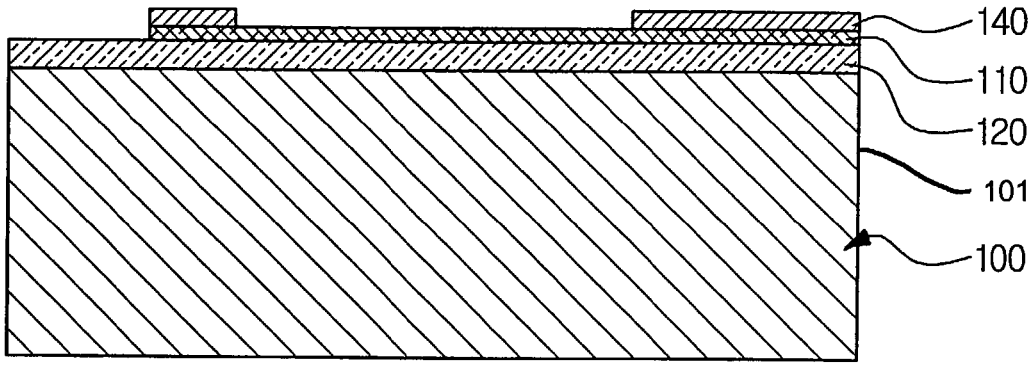
FIGS. 3A through 3H are process diagrams illustrating sequential operations of a method of manufacturing the head of the inkjet printer in accordance with another embodiment of the present invention.
Figure 3B:
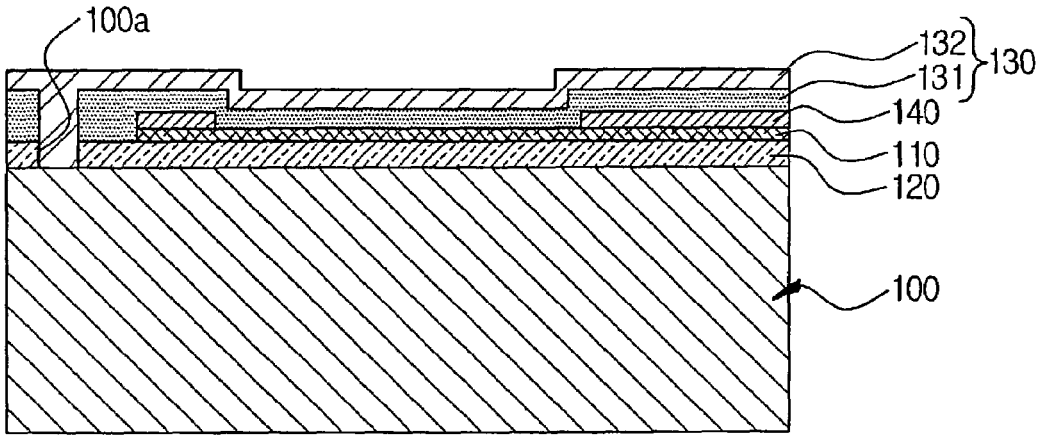
Figure 3C:
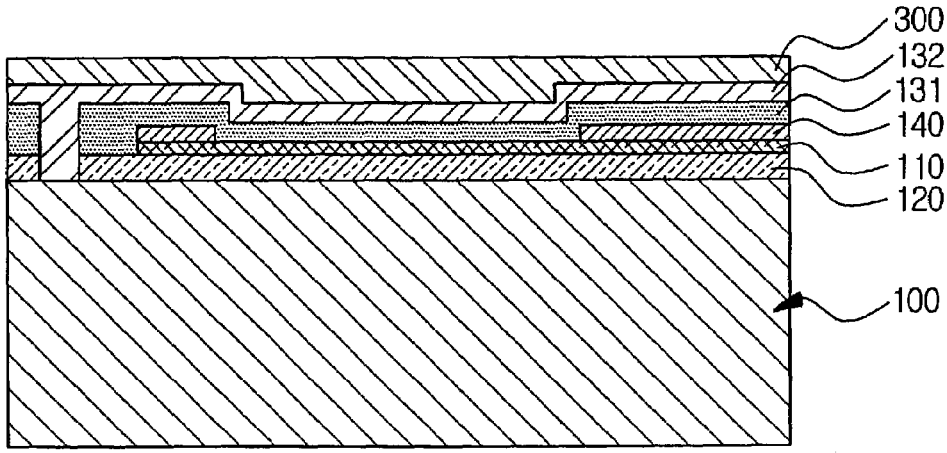
Figure 3D:
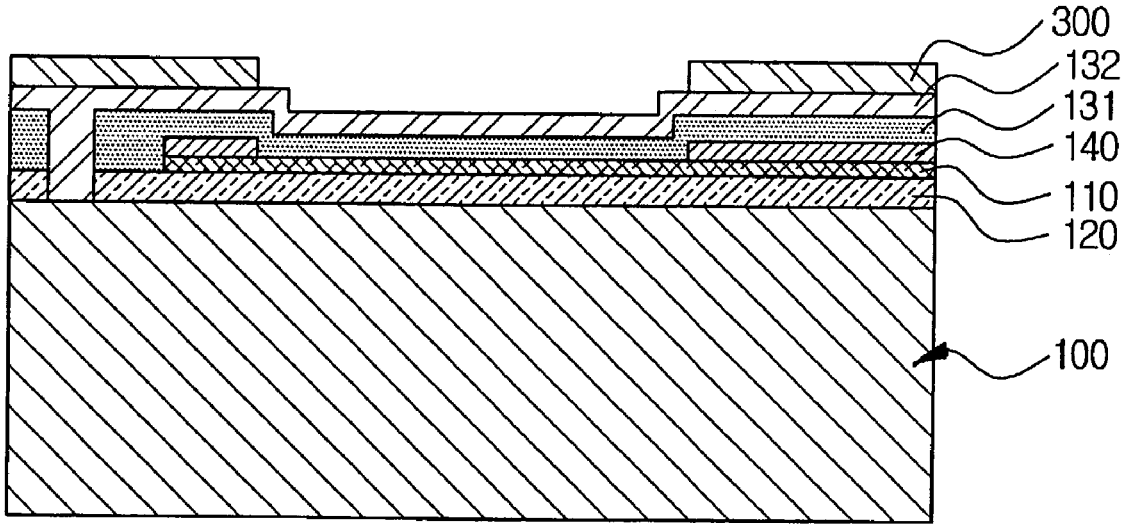
Figure 3E:
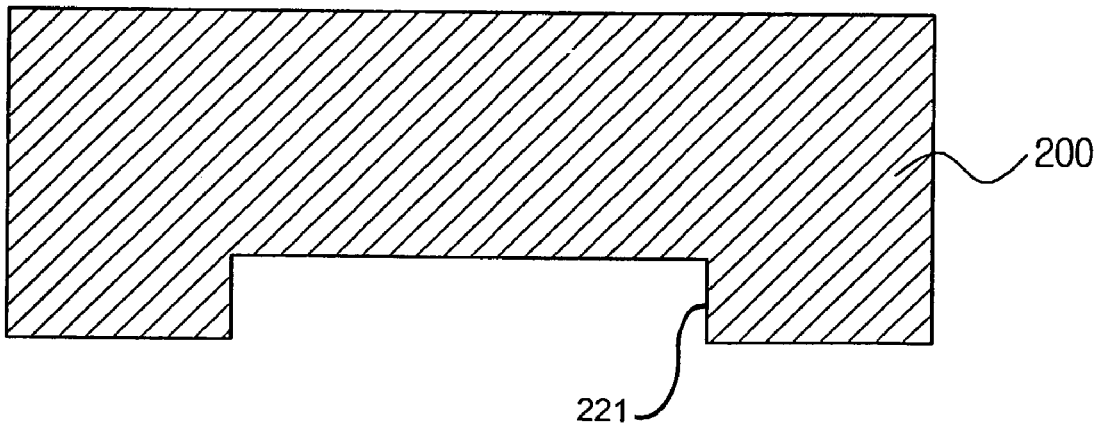
Figure 3F:
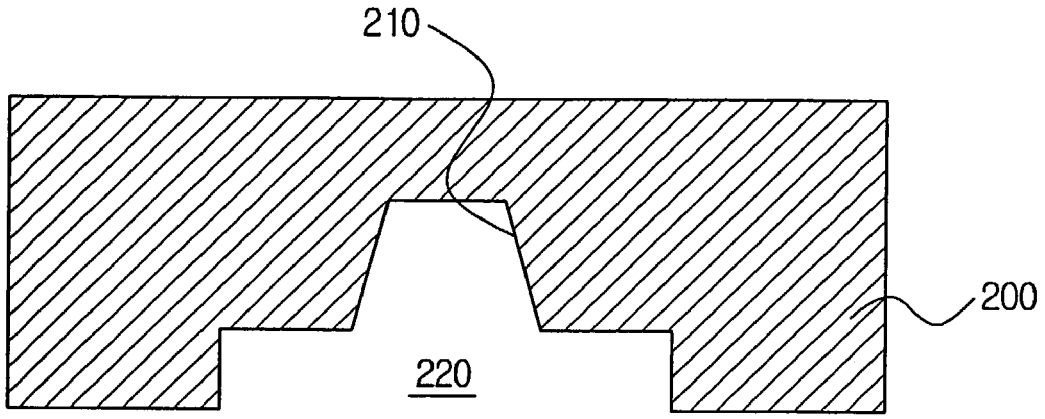
Figure 3G:
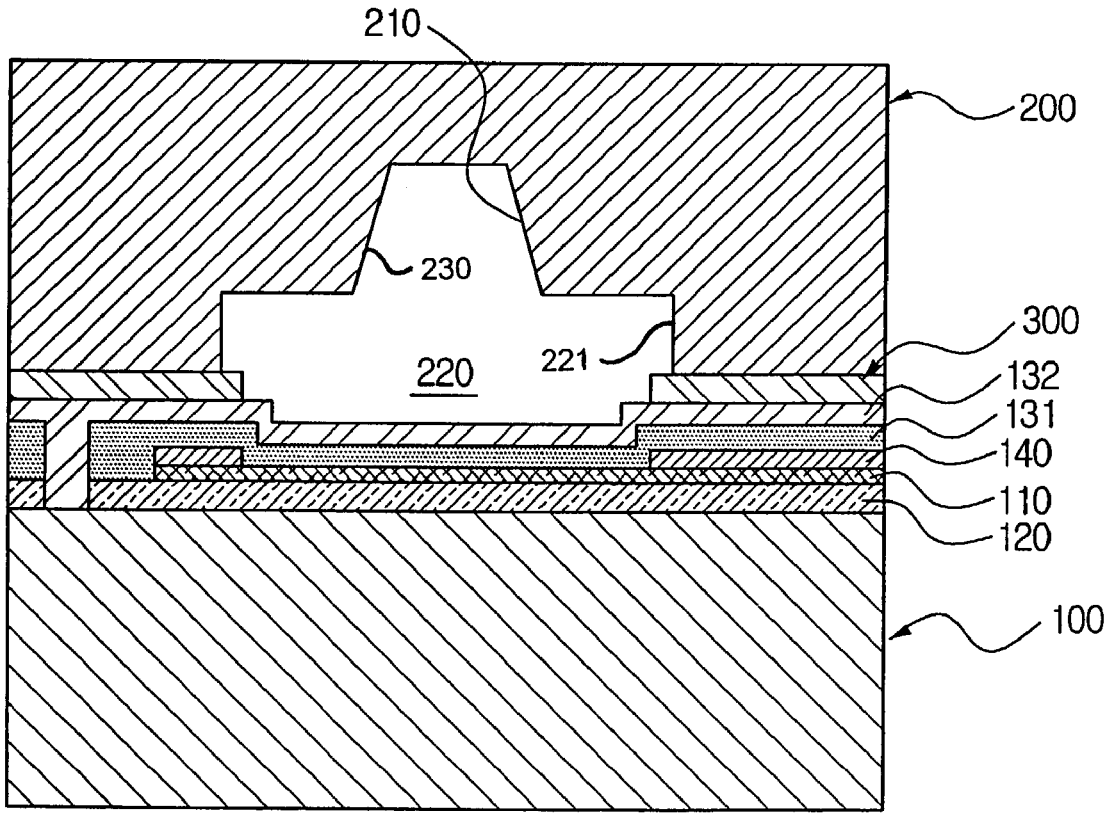
Figure 3H:
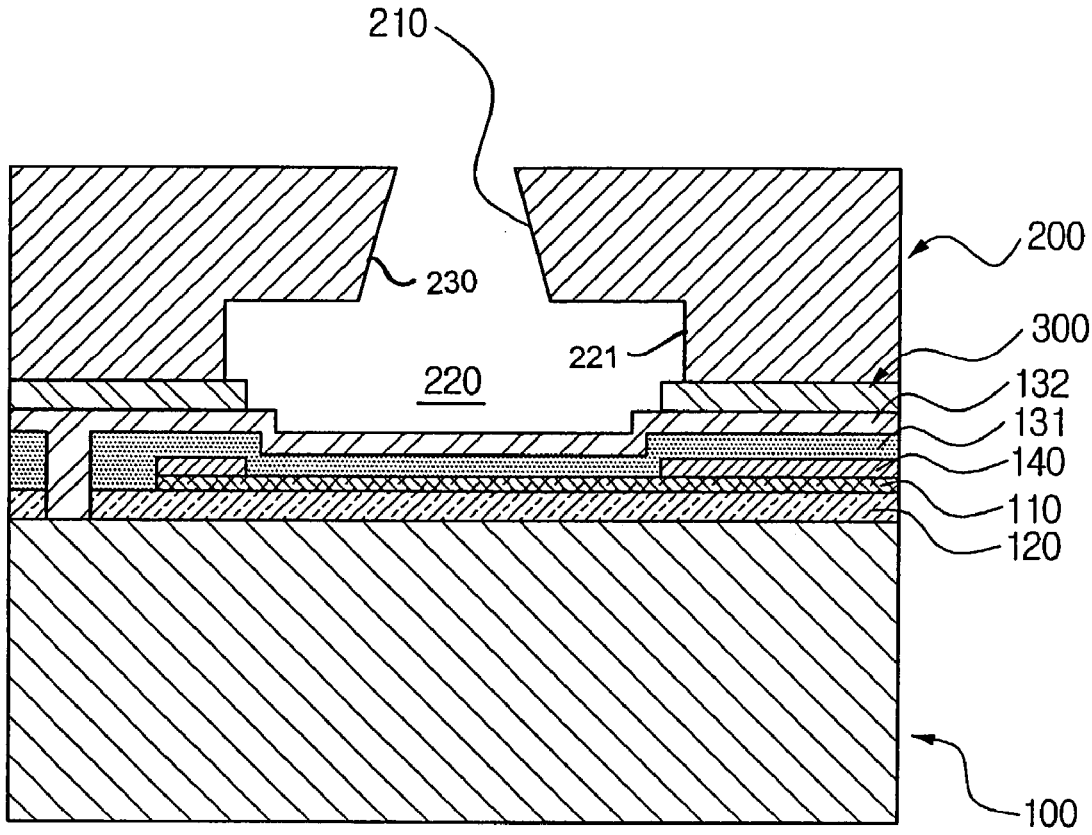
Figure 4:
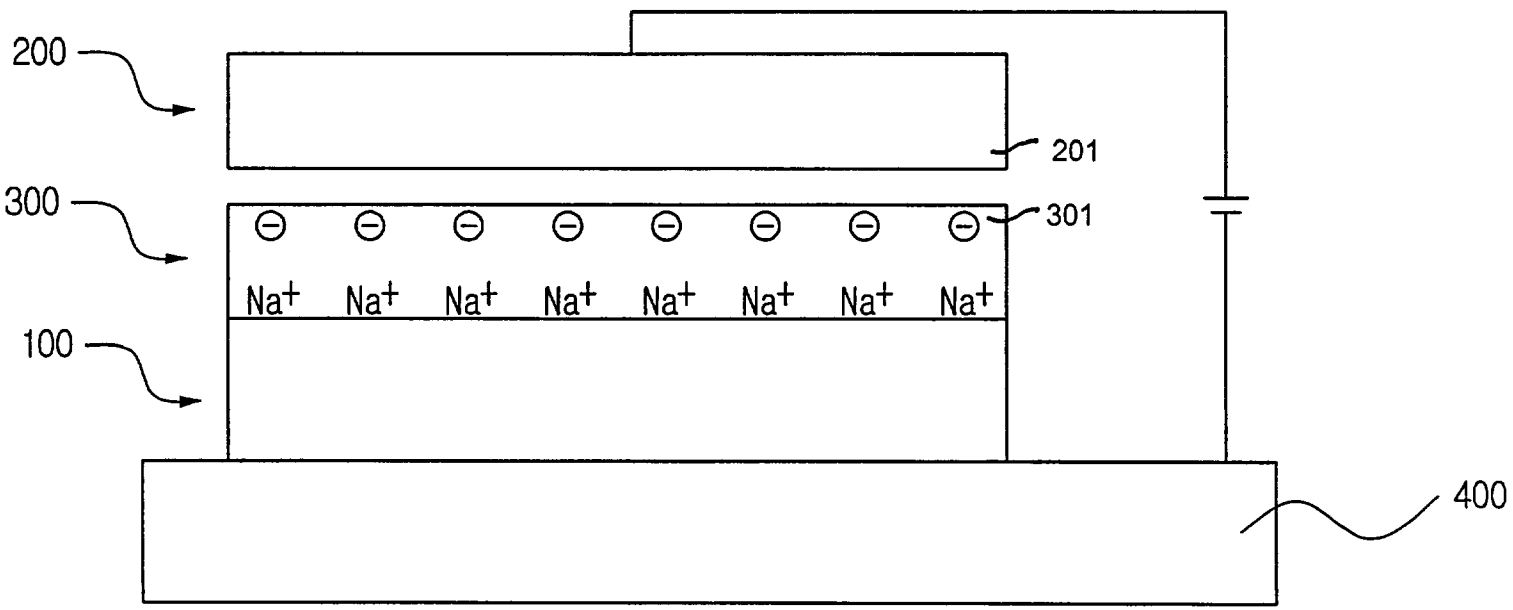
FIG. 4 is a schematic diagram showing a bonding principle of a nozzle substrate and a heater substrate in the method of manufacturing the head of the inkjet printer as shown in FIGS. 3A through 3H.

FIG. 2 is a cross-sectional diagram illustrating the head of the inkjet printer in accordance with an embodiment of the present invention, FIGS. 3A through 3H are process diagrams illustrating sequential operations of the method of manufacturing the head of the inkjet printer in accordance with another embodiment of the present invention, and FIG. 4 is a schematic diagram showing an electric field arrangement when an electric field is applied after heating in the method of manufacturing the head of the inkjet printer as shown in FIGS. 3A through 3H.

Referring to FIG. 2, the head of the inkjet printer includes a heater substrate 100, a nozzle plate 200, an intermediate layer 300 bonding the heater substrate 100 and the nozzle plate 200, an ink chamber 220 formed by bonding the heater substrate 100 and the nozzle plate 200, and a passivation layer 130 vapor-deposited on the heater substrate 100 to protect a heater thin film 110.

The heater substrate 100 includes a silicon substrate 101, a heatproof layer 120 formed by vapor-depositing SiO2 on the silicon substrate 101 to prevent heat of the heater from being discharged, and a heater thin film 110 performing a heating operation. The passivation layer 130 includes an insulating film 131 made of SiN:H and vapor-deposited on the heater thin film 110 to protect the heater thin film 110, and a heater protecting film 132 made of Ta. An electrode 140 is formed between the heater thin film 110 and the insulating film 131 of the passivation layer 130. In order to improve durability and chemical resistance of the head, SiC:H may be additionally vapor-deposited on the insulating film 131. The heater protecting film 132 has one side 100*a* electrically connected to the silicon substrate 101. The nozzle plate 200 includes an ink barrier 221 formed by etching a silicon plate and a nozzle 210. When the nozzle plate 200 and the heater substrate 100 are bonded, an ink chamber 220 is formed by the ink barrier 221. The intermediate layer 300 is formed by forming a thin film of glass on the passivation layer 130 by vapor-depositing. The thin film of glass has a low melting point and contains at least 60% silicon oxide. The ink barrier 221 may be formed on the heater substrate 100.

In accordance with the present invention, as illustrated in FIGS. 3A to 3H, the method of manufacturing the head of the inkjet printer includes a heater substrate formation operation (FIG. 3A), an intermediate layer formation operation (FIGS. 3C and 3D), a nozzle plate formation operation (FIGS. 3E and 3F), and a heater substrate and nozzle plate bonding operation (FIG. 3G). As depicted in FIG. 3A, the heater substrate 100 is formed through the following operations. The heatproof layer 120 is formed on the silicon substrate 101 to prevent thermal energy generated by the heater thin film 110 from being discharged to the silicon substrate 101 disposed below the heater thin film 110. It is possible that the heatproof layer 120 is formed by vapor-depositing $SiO_2$ to a thickness of 1 to 5 $\mu$m. The heater thin film 110 is formed on the silicon substrate 101 where the heatproof layer 120 is vapor-deposited. It is possible that the heater thin film 110 is formed by vapor depositing Ta—Al alloy to a thickness of 500 to 5000 Å. A conductive layer, such as an electrode, transmits power to the heater thin film 110 so that the heater thin film 130 can perform the heating operation.

FIG. 3B shows forming the passivation layer 130 protecting the heater thin film 110. In this embodiment, the passivation layer 130 includes the insulating film 131 and the heater protecting film 132 to protect the heater thin film 110. It is possible that the insulating film 131 is formed by vapor-depositing SiN:H to a thickness of 0.1 to 1.01 $\mu$m, and the heater protecting film 132 is formed by vapor-depositing tantalum (Ta) to a thickness of 0.1 to 1.0 $\mu$m. The heater protecting film 132 has one side 100*a* connected to the silicon substrate 101, so that ions can pass through the one side 100*a* in an electric field to perform a bonding operation. SiCH may be additionally vapor-deposited on the insulating film 131 made of SiN:H to improve a chemical resistance of the passivation layer 130. Ta has high malleability and ductility, is hardly oxidized, and is not melted in acids except for hydrofluoric acid, to protect the heater thin film 110. The insulating film 131 and the heater protecting film 132 prevent cavitation and oxidation of the heater thin film 110 due to heat and pressure.

As depicted in FIG. 3C, the intermediate layer 300 is made of a thin film of glass and is formed on the heater protecting film 132 having a thickness of 0.1 to 5 $\mu$m by vapor-depositing. It is possible that the glass thin film is formed according to injection or E-beam evaporation, which are general thin film vapor-deposition methods, and spin on glass (SOG) using liquid glass. Referring to FIG. 3D, a heater region of the glass thin film receiving heat from the heater thin film 110 is patterned and etched.

The nozzle plate 200 is formed by forming the ink barrier 221 and the nozzle 210 on the silicon plate according to two-step etching. The ink barrier 221 is formed to a thickness of 10 to 40 $\mu$m as shown in FIG. 3E, and the nozzle 210 is formed in a predetermined position to a depth of 10 to 40 μm according to additional patterning and etching of the silicon plate 210 as shown in FIG. 3F.

As illustrated in FIG. 3G, the heater substrate 100 and the nozzle plate 200 are bonded by forming a flat glass thin film as the intermediate layer 300 and by applying the heat and electric field to the intermediate layer 300. Referring to FIG. 4, the heater substrate 100 where the nozzle plate 200 is positioned, is installed on a thermal plate 400 made of a conductive material, and electrodes of a power source are connected to the nozzle plate 200 and the thermal plate 400, so that the heater substrate 100 can be heated by the thermal plate 400. A heating temperature ranges between room temperature and 500° C., so that positive ions can be sufficiently moved due to the electric field, and the passivation layer 130 (131,132) formed on the heater substrate 100 can be protected. In addition, the electric field is selected from DC 300 to 1000V regions according to a thickness and component of the intermediate layer 300.

The bonding operation will now be explained in detail with reference to FIG. 4. When the temperature rises, and when the electric field is applied to the intermediate layer 300, the positive ions of the intermediate layer 300 actively move toward an interface surface 301 of the intermediate layer 300 in a cathode side to obtain neutrality. Remaining negative ions of the intermediate layer 300 form a space charge layer on an Si surface 201 of the nozzle plate 200. The electric field is concentrated in the space charge layer to operate a strong electrostatic force, thereby bonding oxygen ions of the glass thin film of the intermediate layer 300 and Si of the nozzle plate 200. That is, $SiO_2$ is thinly grown on the interface surface 301 to fill up a boundary between the nozzle plate 200 and the intermediate layer 300, so that the heater substrate 100 and the nozzle plate 200 are bonded with the electrostatic force of the $SiO_2$.

FIG. 3H shows a bonded structure of the heater substrate 100 and the nozzle plate 200. When an outer portion of the nozzle plate 200 is CMP-processed to open (expose) the nozzle 210 and a signal connection region relating to an ink ejection operation, manufacturing of the head is finished.

When energy is supplied to the heater thin film 110 of the head to overheat ink for 2 to 3 μs, a bubble is formed on the heater thin film 111, and ink of the ink chamber 220 is externally ejected through the nozzle 210 due to a volume and a pressure of the bubble .

The ink chamber 220 and nozzle 210 which correspond to each heater chip are set up by bonding the heater substrate 100 and the nozzle plate 200, thus forming a passage of ink. Accordingly, bonding or adhesion of components of the head improves reliability of the head of the inkjet printer.

In accordance with the present invention, the heater substrate 100 and the nozzle plate 200 are bonded by silicon-glass-silicon bonding. That is, the glass thin film having an almost identical thermal expansion coefficient to Si forming the nozzle plate 200 is vapor-deposited on the heater substrate 100 to form silicon-glass-silicon bonding between the nozzle plate 200 and the heater substrate 100 through the intermediate layer 300.

In accordance with the present invention, in manufacturing the head of the inkjet printer, the heater substrate and the nozzle plate are bonded with the electrostatic force by using the glass thin film instead of a general polymer bonding layer, thereby preventing ink penetration into respective layers of the head occurring when the polymer bonding layer is used. Moreover, the bonding process is performed in wafer units, which results in high mass productivity. In addition, the passage and the nozzle are formed on the nozzle plate according to the photoresist printing and etching, to improve integration of the head.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. A head of a bubble-jet type inkjet printer, comprising:
- a substrate having a heater generating a bubble in ink;
- a passivation layer including an insulating film and a heater protecting film, the heater protecting film protruding through the insulating film and being connected at one side to the substrate;
- a nozzle plate having a nozzle to discharge the ink heated by the heater; and
- an intermediate layer bonding the substrate and the nozzle plate with an electrostatic force.

2. The head according to claim 1, wherein the passivation layer is formed on the substrate so as to protect the heater.

3. The head according to claim 2, wherein the insulating film is vapor-deposited on the heater.

4. The head according to claim 1, wherein the substrate comprises:
- a silicon substrate where the heater is installed; and
- a heatproof layer formed between the silicon substrate and the heater to prevent heat of the heater from being discharged toward the substrate.

5. The head according to claim 1, wherein the nozzle plate comprises:
- a silicon plate; and
- an ink passage formed on the silicon plate and connected to the nozzle to supply the ink.

6. The head according to claim 1, wherein the intermediate layer comprises:
- a thin film of glass formed on the heater substrate by vapor-depositing.

7. The head according to claim 1, wherein the intermediate layer comprises:
- a glass thin film having a low melting point and containing at least 60% of silicon oxide.

8. A head of a bubble-jet type inkjet printer, comprising:
- a heater having a substrate, a heat proof layer formed on the substrate, and a secondary heater formed on the heat proof layer;
- a passivation layer, including an insulating film that is formed on the substrate and the heat proof layer and a heater protection layer that is formed on the insulating film, a portion of the heater protection layer contacting the substrate to allow ions to pass therethrough;
- an intermediate layer formed on the passivation layer to be electrically connected to the substrate through the portion of the heater protection layer; and
- a nozzle plate having a nozzle, forming an ink chamber with the substrate, stacked on the intermediate layer, and bonded to intermediate layer by an electric field formed between the substrate and the nozzle plate through the portion of the heater protection layer.

9. The head according to claim 8, wherein the substrate and the nozzle plate are made of silicon, and the intermediate layer is made of glass.

10. The head according to claim 9, further comprising:
- a silicon layer formed in an interface of the intermediate layer and the nozzle plate by the electric field so that the nozzle plate is bonded to the substrate of the substrate through the silicon layer and the intermediate layer.

11. The head according to claim 10, wherein the interface comprises a boundary formed of the intermediate layer and the nozzle plate, and the silicon layer fills up the boundary of the interface.

12. The head according to claim 10, wherein the silicon layer is made of $SiO_2$.

13. The head according to claim 10, wherein the silicon layer is formed when heat is applied to raise a temperature of the substrate and the intermediate layer.

14. The head according to claim 13, further comprising an electrical circuit formed between the heater plate and the nozzle plate through the portion of the passivation layer and the intermediate layer, wherein the electric field is formed, and the temperature is raised due to the electrical circuit.

15. The head according to claim 9, wherein the intermediate layer comprises a first side contacting the passivation layer and a second side contacting the nozzle plate, and the second side of the intermediate layer is formed with a space charge layer filled with oxygen ions corresponding to the silicon of the nozzle plate when the electric field is applied to the intermediate layer and the nozzle plate.

16. The head according to claim 15, wherein the oxygen ions of the second side of the intermediate layer is bonded to the silicon of the nozzle plate to form a silicon layer in a boundary between the intermediate layer and the nozzle plate.

17. The head according to claim 16, wherein the first side of the intermediate layer is filled with positive ions while the second side of the intermediate is filled with negative ions due to the electric field.

18. The head according to claim 8, wherein the intermediate layer has a thermal expansion coefficient which is substantially the same as that of an element consisting of the nozzle plate.

19. The head according to claim 8, wherein the nozzle plate is bonded to the intermediate layer by silicon-glass-silicon bonding.

20. The head according to claim 8, wherein the nozzle plate is not bonded to the intermediate layer by a polymer bonding layer.

* * * * *